United States Patent [19]

Schroeder

[11] Patent Number: 4,583,950

[45] Date of Patent: Apr. 22, 1986

[54] LIGHT PEN MARKSMANSHIP TRAINER

[76] Inventor: James E. Schroeder, 1331 Peacock Ave., Columbus, Ga. 31906

[21] Appl. No.: 646,322

[22] Filed: Aug. 31, 1984

[51] Int. Cl.[4] ..... A63F 9/22

[52] U.S. Cl. ..... 434/22; 273/310; 273/312

[58] Field of Search ..... 273/310, 311, 312; 434/20, 21, 22

[56] References Cited

U.S. PATENT DOCUMENTS

| | | | |
|---|---|---|---|
| 3,083,474 | 4/1963 | Knapp | 273/310 |
| 3,271,032 | 9/1966 | Rabinowitz | 273/310 |
| 4,395,045 | 7/1983 | Baer | 434/22 |
| 4,452,458 | 6/1984 | Timander et al. | 273/310 |

FOREIGN PATENT DOCUMENTS

| | | | |
|---|---|---|---|
| 3002923 | 7/1981 | Fed. Rep. of Germany | 273/310 |

*Primary Examiner*—William H. Grieb
*Assistant Examiner*—Leo P. Picard

[57] ABSTRACT

An illustrative embodiment of the invention provides marksmanship training in a realistic environment. A "light pen" is clamped to the muzzle of a weapon. The "light pen" and weapon are aimed at a microcomputer-generated target or videodisc-player-generated target on the screen of a television monitor. A trigger switch on the weapon is closed when the marksman perceives the correct orientation between the weapon and the target. The microcomputer calculates the proper trajectory of the simulated "round" based on the orientation of the "light pen" relative to the screen at the time the trigger switch is closed in order to generate and display the calculated shot impact point for the benefit of the trainee marksman.

2 Claims, 2 Drawing Figures

LIGHT PEN MARKSMANSHIP TRAINER

The invention described herein was made by an employee of the U.S. Government, and may be manufacutured and used by or for the government for governmental purposes without payment of any royalties thereon or therefore.

BACKGROUND OF THE INVENTION

This invention relates to training devices and, more particularly, to a light pen for temporary attachment to a weapon to register the orientation of the weapon relative to an image on a television screen, and the like.

Marksmanship training devices have been in use almost as long as firearms. The need for training devices of this nature arises from many sources. Thus, in its initial stages, at least, marksmanship training is much more effective if it is conducted in a relatively calm stress-free atmosphere away from the obvious tensions of the firing range and the presence of live ammunition. Cost reduction is another important consideration in the application of training devices to firearms proficiency. Illustratively, ammunition, even "training" ammunition, is expensive not only on a unit cost basis, but also from the standpoint of transporation, storage, accountability control and issue.

There is the further problem of the availability of suitable firing ranges. Certainly, for many modern weapons, ranges must be large. In these circumstances, there are just a limited number of possible ranges that can be used for "live firing" training purposes. Range utilization scheduling, the expense and the inconvenience of moving troops and equipment to and from these facilities are, to identify just a few reasons, further examples of the very pressing need to develop realistic alternatives to "live firing" exercises.

Aside from the need for introducing genuine economies in military training with arms of all sorts, there also are a number of non-military needs for some apparatus that will assist in establishing and maintaining proficiency with small arms without using "live" or "ball" ammunition. Typically, police forces, sportsmen, competitive marksmen and the like, all may wish to train regularly with weapons in the absence of frequent accessibility to suitable "live firing" range facilities.

There is still a further need for marksmanship apparatus for amusement, or "arcade" application. A visit to any "arcade" will show at a glance that weapons simulators and marksmanship related devices are among the more popular devices. Consequently, improvements in apparatus of this nature that will increase realism will certainly enhance user, or player interest and entertainment.

Thus, there is a need for an improved device that can be adapted to a large number of weapons, incorporate important principles of marksmanship heretofore not available in devices of this character and create a more realistic environment for training or entertainment purposes.

SUMMARY OF THE INVENTION

These and other marksmanship training needs are satisfied, to a great extent, through the practice of the invention.

The invention, typically, provides for temporarily mounting a "light pen" on a conventional or dummy weapon. The "light pen" is unusual in that it is provided with one or more lenses for focusing light on the pen's photosensitive element from the portion of a television screen at which the pen is aimed at a distance of four to twenty feet. The combination "light pen" and weapon is aimed at a target on a television screen or raster and "fired" when the user perceives a correct relation between target and weapon. A computer coupled to the "light pen" and the circuit for the television screen calculates the proper trajectory for the simulated round and informs the user of the impact point of the hypothetical shot. In this manner, the user is made aware of errors in aiming and can take any corrective action that may be necessary during subsequent exercises.

Through the use of a television screen, greater realism can be introduced into the training. Thus, by projecting films of actual targets on the television screen with, for example, a videodisc player, and, through the associated computer, to introduce wind and target motion effects as well as other simulated phenomena, the invention provides enhanced realism and much more thorough marksmanship training than that which heretofore has been available through other devices.

The usual inconveniences and expenses, moreover, that are associated with "live firing" exercises are completely avoided through the practice of the invention.

Consequently, there is provided an improved marksmanship training and amusement device. For a more complete appreciation of the invention, attention is invited to the following detailed description, taken in conjunction with the drawing. The scope of the invention, however, is limited only through the claims appended hereto.

DETAILED DESCRIPTION OF THE PREFERRED EMBODIMENT

Figure 1:
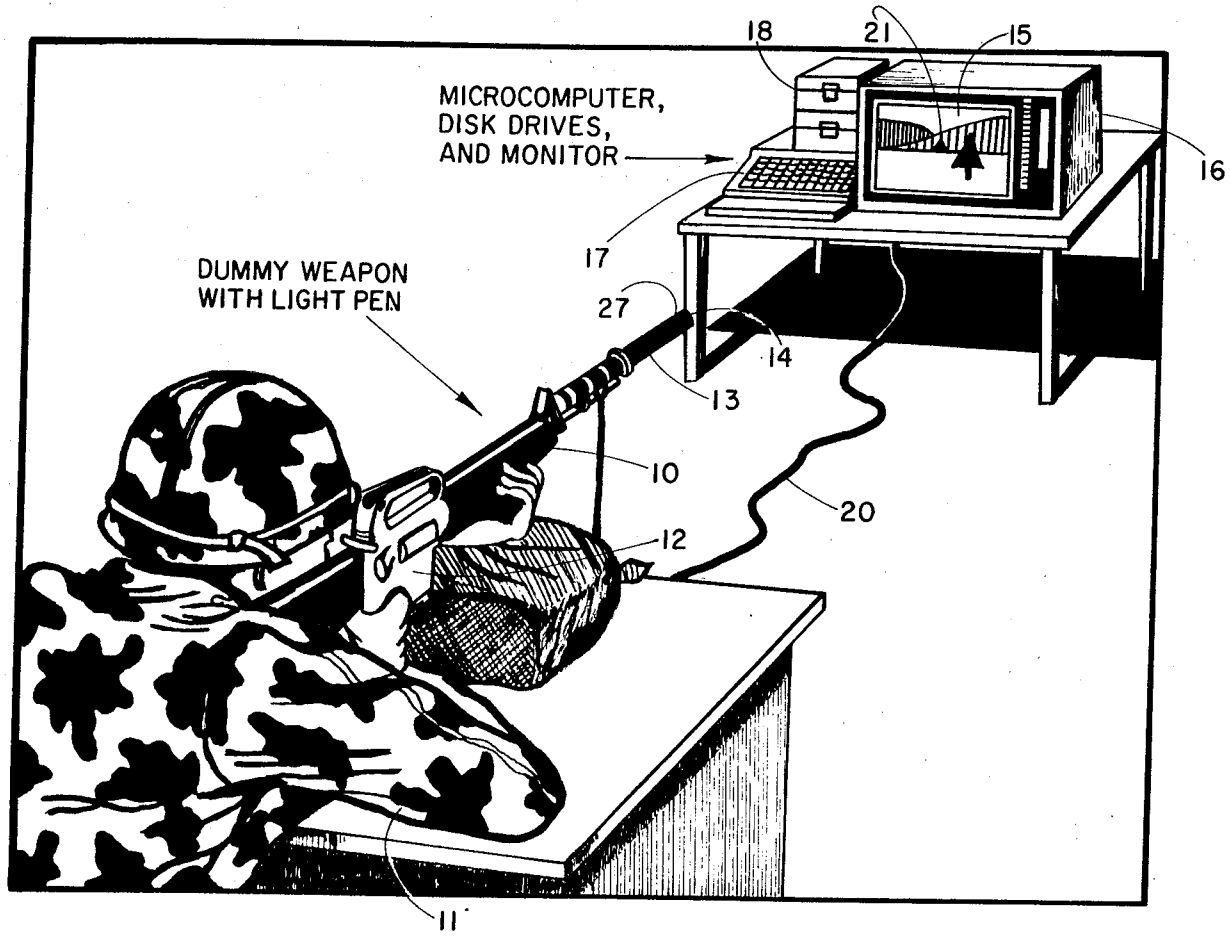
FIG. 1 of the drawing is a perspective view of a typical apparatus for practicing the invention.

For a more complete appreciation of the invention, attention is invited to the embodiment shown in FIG. 1 of the drawing. As illustrated, a conventional or dummy rifle 10 is held in firing position by a marksman 11. The rifle 10 has an electrical trigger switch mechanism 12 associated with the actual trigger of the rifle, which is concealed by the hand of the marksman 11 in the drawing.

Temporarily attached to the muzzle of the rifle 10 is a light pen 13. A typical light pen suitable for use in connection with the invention is described in more complete detail in the text "Professional Light Pen Manual, Apple II E, II +, III Computer" published by Symtec Inc., 15933 W. 8 Mile Rd., Detroit, Mich. 48235. The light pen 13, which will be described subsequently in more complete detail, has a photosensitive end 14 that is spaced four to twenty feet from a television screen 15 on a television monitor 16, e.g. a SONY Trinitron Model No. CUM-1250.

The system under consideration is completed by coupling a microcomputer 17 and one or more associated disk drives 18 to both the television monitor 16 and, through a cable 20, to the light pen 13 and the trigger switch 12. For the purposes of the invention, an Apple II+computer has produced acceptable results.

Figure 2:
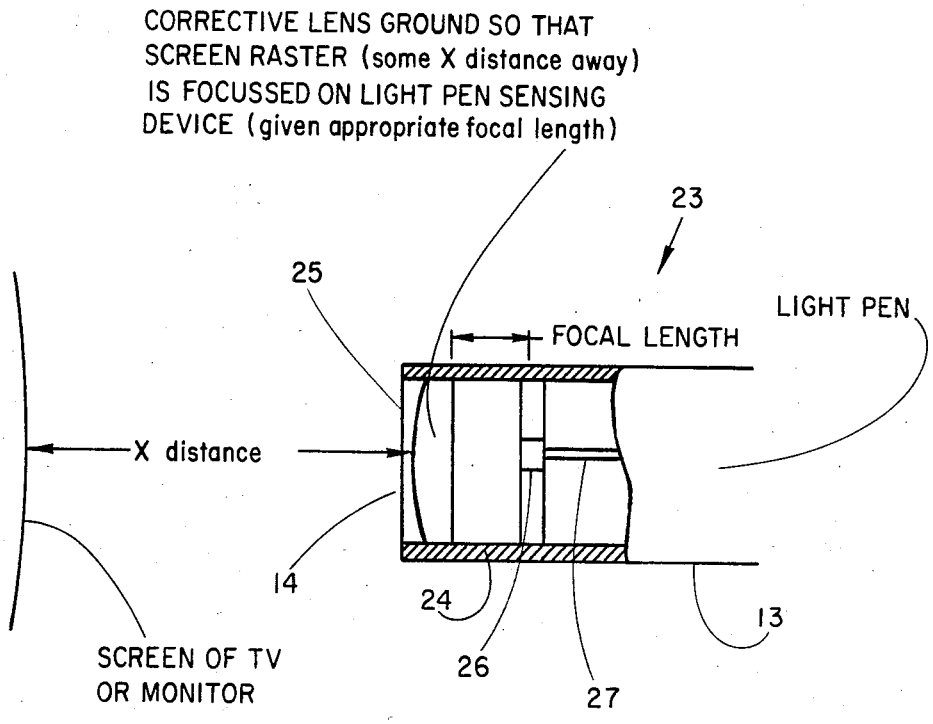
FIG. 2 is a schematic diagram of a lens and "light pen" combination suitable for use in connection with the invention.

As best shown in FIG. 2, an important feature of the invention is the focussing apparatus 23 mounted in the photosensitive end 14 of the light pen 13. As hereinbefore mentioned, "light pens" that have characterized the prior art ordinarily are touched directly to the surface of the television screen or, at least, brought to within a few inches of the screen in order to generate a signal that identifies the portion of the screen with which the pen is aligned. Lenses, to the extent that they may have been used in these prior art systems, accommodate to very short distances, e.g. direct contact with or a few inches of separation from the television screen.

In accordance with the invention, however, it has been discovered that the light pen 13 can function accurately and effectively at distances of four to twenty feet from the television screen 15 (FIG. 1). For the purposes of the invention, this is a significant achievement in that it permits marksmanship training to be conducted in a much more relistic manner than that which would have been possible with the muzzle of the rifle 10 and its associated light pen pressed against, or spaced only a few inches from the television screen 15.

To provide this focus at longer ranges from the television screen 15, the focusing apparatus 23 that is shown in FIG. 2 has been included as an example. One or more lenses could be used to create the resulting coverging lens system, but for the purpose of this example, a one-lens system is depicted. As shown, the apparatus 23 has a generally cylindrical housing 24 that is open on the muzzle or photosensitive end 14 of the light pen 13. A converging lens 25 is mounted within the housing 24, adjacent to the open, photosensitive end 14 of the light pen 13.

A light pen photosensitive device 26 is spaced inwardly of the lens 25 by an axial distance that is equal to the distance from the lens to the focused real image. The distance from the lens to the focused real image is jointly determined by the distance from the lens to the TV screen and the focal length of the lens. The photosensitive device 26, moreover, is in axial alignment with the center of the lens 25 in order to attain the full benefit of the longer distance focusing and light-concentration effects of the lens.

Conductors 27 send electrical signals from the photosensitive device 26 to the light pen. The trigger switch mechanism 12 (FIG. 1) also provides electrical signals to the light pen indicating whether the trigger has been pulled. The light pen relays these information signals to the microcomputer 17 through the cable 20. In this way, detailed information about where the weapon was aimed before, during and after trigger manipulation can be gathered, analyzed, and stored by the microcomputer. Such information provides valuable feedback information and diagnosis for the shooter about such classic marksmanship errors as trigger jerk, steady position, aiming, and flinch.

In operation, the light pen 13 and its light sensitive end 14 responds to light on the screen 15 by generating a signal that allows the computer to access the coordinates or position of the observed light on the screen. The mechanical and electrical connections between the light pen 13, the cable 20 and the microcomputer 17 that produce this signal are described in more complete detail in the Symtec Inc. manual noted above.

The microcomputer 17, moreover, is programmed to present a target 21 on the screen 15 or is coupled to a videodisc player, e.g., a SONY Model No. LDP1000, for projecting a target 21 on the screen 15. In response to the signal from the light pen 13 and the associated program that defines the position of the photosensitive end 14 of the pen relative to the target 21 on the screen 15 at the time the trigger switch 12 is closed, the microcomputer 17 calculates the trajectory appropriate to the rifle 10. The microcomputer 17 then provides an indication of the shot impact relative to the target 21. The indication of shot impact can be audible, visual or both, in order to inform the marksman 11 of his error and to enable the marksman to exercise correct judgment with subsequent simulated or actual firing exercises.

Ordinarily, "light pens" have one or more lenses to enhance the accuracy of the pen's definition of the light from the specific group of phosphor dots, or pixel, on the television screen 15 to which the pen is responding. The common application of these light pens, however, is in very close proximity, often touching the television screen. In accordance with a salient feature of the invention, however, the light pen 13 is provided with one or more lenses 22 of which the lens 25 shown in FIG. 2 is typical, that enhance the definition of the group of phosphors on the screen 15 with which the rifle 10 is aligned at a substantial distance, of perhaps, four to twenty feet from the screen. Thus, the lenses 22 for focusing the light pen 13 that characterizes the invention have a function that is entirely different from lenses that may have been used in prior art "light pen" structures.

Turning now to the program for the microcomputer 17, it has been found, for example, that an Apple Language Card with Pascal language software are suitable for enabling appropriate images to appear on the screen 15 and for executing the necessary trajectory and shot impact response calculation. This software has enough flexibility to permit targets to appear at different, predetermined locations on the screen 15, to move at constant or varying speeds, and to introduce the effect of wind on projectile trajectory. The computed impact point of each simulated "round" also is, as mentioned above, displayed to permit the marksman to note the error in the preceding "round" and to make the necessary correction in subsequent firing exercises.

Thus, there is provided a relatively inexpensive apparatus for providing realistic training. This apparatus, moreover, introduces through its flexibility a much greater training potential than that which heretofore has been available. Target motion, windage and indications of calculated shot impact, for example, all are possible through this apparatus in contrast to that which heretofore has been available.

I claim:

1. A marksmanship training apparatus comprising, a television monitor having a screen for presenting target images thereon, a photosensitve device spaced from four to twenty feet from said screen and responsive to light emitted therefrom, a converging lens system for interposition between said photosensitive device and said screen for focussing the real image of said screen on said photosensitive device as a function of the distance from the lens to the screen and the focal length of the lens, a microcomputer coupled to said light pen and said television monitor for producing said target images on said screen and for indicating the relationship between said light pen and said target images, a videodisc player coupled to said microcomputer and said television monitor for producing said target images on said screen, a firearm attached to said photosensitve device and said converging lens system in which said photosensitve device transmits information to said microcomputer about point of aim of said firearm, and a trigger switch on said firearm electrically coupled to said photosensitive device to signal said microcomputer in response to trigger manipulation.

2. A training apparatus according to claim 1 wherein said firearm comprises a dummy firearm.

* * * * *